US012215500B2

(12) United States Patent
Goodrum

(10) Patent No.: US 12,215,500 B2
(45) Date of Patent: Feb. 4, 2025

(54) COMPOSITE ROOFING MEMBRANE AND METHODS THEREOF

(71) Applicant: Siplast, Inc., Irving, TX (US)

(72) Inventor: Kirk Goodrum, Arkadelphia, AR (US)

(73) Assignee: Siplast, Inc., Irving, TX (US)

( * ) Notice: Subject to any disclaimer, the term of this patent is extended or adjusted under 35 U.S.C. 154(b) by 30 days.

(21) Appl. No.: 17/846,791

(22) Filed: Jun. 22, 2022

(65) Prior Publication Data

US 2022/0403660 A1 Dec. 22, 2022

Related U.S. Application Data

(60) Provisional application No. 63/213,454, filed on Jun. 22, 2021.

(51) Int. Cl.
*E04D 11/02* (2006.01)

(52) U.S. Cl.
CPC ..... *E04D 11/02* (2013.01)

(58) Field of Classification Search
CPC E04D 11/02; E04D 5/10; B32B 27/32; B32B 27/30; B32B 2419/06
See application file for complete search history.

(56) References Cited

U.S. PATENT DOCUMENTS

| | | | | |
|---|---|---|---|---|
| 4,442,148 | A | 4/1984 | Stierli | |
| 5,979,133 | A | 11/1999 | Funkhouser | |
| 6,764,733 | B1 * | 7/2004 | Clarke | E04D 5/10 52/90.2 |
| 10,065,394 | B2 | 9/2018 | Tang et al. | |
| 11,053,686 | B2 * | 7/2021 | Simonis | B32B 27/365 |
| 11,428,008 | B2 * | 8/2022 | Yang | B32B 27/08 |
| 2006/0292945 | A1 * | 12/2006 | Kuhn | E04D 5/10 442/41 |
| 2009/0320987 | A1 * | 12/2009 | Hubbard | B32B 15/14 428/354 |
| 2014/0261965 | A1 | 9/2014 | Tang et al. | |
| 2015/0337534 | A1 | 11/2015 | Miller et al. | |
| 2019/0316359 | A1 | 10/2019 | Tang et al. | |
| 2022/0178144 | A1 | 6/2022 | Wang et al. | |

FOREIGN PATENT DOCUMENTS

| | | | |
|---|---|---|---|
| EP | 3611308 | A1 | 2/2020 |
| WO | 2016/011444 | A1 | 1/2016 |
| WO | 2017/165868 | A1 | 9/2017 |

* cited by examiner

*Primary Examiner* — Adriana Figueroa
(74) *Attorney, Agent, or Firm* — GREENBERG TRAURIG, LLP

(57) ABSTRACT

Some embodiments of the present disclosure are directed to a composite roofing membrane. In some embodiments, the composite roofing membrane comprises a roofing membrane and a roofing composite. In some embodiments, the roofing composite comprises a cap layer and a reinforcing material. In some embodiments, composite roofing membrane comprises an adhesive positioned between the roofing composite and the roofing membrane. In some embodiments, the adhesive comprises a moisture-cure adhesive. In some embodiment, the adhesive comprises a silane-terminated polymer, a polymethylmethacrylate or combinations thereof.

16 Claims, 2 Drawing Sheets
(1 of 2 Drawing Sheet(s) Filed in Color)

COMPOSITE ROOFING MEMBRANE AND METHODS THEREOF

CROSS-REFERENCE TO RELATED APPLICATION

This application claims the benefit of priority to provisional application No. 63/213,454, filed Jun. 22, 2021, titled "COMPOSITE ROOFING MEMBRANE AND METHODS THEREOF," the entire disclosure of which is incorporated by reference herein.

FIELD

The present disclosure relates to composite roofing membranes and methods of forming and installing the composite roofing membranes.

BACKGROUND

Single ply roofing membranes typically comprise a cap, a scrim, and a fleece back. In some instances, this configuration permits water migration between the layers of the single ply roofing membrane.

SUMMARY

Covered embodiments are defined by the claims, not this summary. This summary is a high-level overview of various aspects and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings, and each claim.

In some embodiments, a composite roofing membrane comprises a roofing membrane; a roofing composite comprising a cap layer, and a reinforcing material; and an adhesive positioned between the roofing membrane and the roofing composite, wherein the adhesive comprises a moisture-cure adhesive, and wherein the adhesive comprises a silane-terminated polymer, a polymethylmethacrylate or combinations thereof.

In some embodiments, a method of installation comprises obtaining a roofing membrane, wherein the roofing membrane comprises a top surface and a bottom surface, attaching the bottom surface of the roofing membrane to a roofing substrate, obtaining a roofing composite, wherein the roofing composite comprises a cap layer, and a reinforcing material, obtaining an adhesive, wherein the adhesive comprises a moisture-cure adhesive, and wherein the adhesive is selected from at least one of a silane-terminated polymer, a polymethylmethacrylate or combinations thereof, applying the adhesive to the top surface of the roofing membrane, and adhering the roofing composite to the adhesive so as to form a composite roofing membrane.

In some embodiments, a roofing system comprises a composite roofing membrane comprising a roofing membrane; a roofing composite comprising a cap layer, and a reinforcing material; an adhesive positioned between the roofing membrane and the roofing composite, wherein the adhesive comprises a moisture-cure adhesive, and the adhesive comprises a silane-terminated polymer, a polymethylmethacrylate or combinations thereof and a roofing substrate, wherein the composite roofing membrane disposed on the roofing substrate.

In some embodiments, the adhesive directly contacts the roofing membrane.

In some embodiments, the roofing membrane is a styrene-butadiene-styrene (SBS) membrane.

In some embodiments, the composite roofing membrane comprises a coating on a top surface of the roofing membrane, wherein the coating is selected so as to reduce oil migration from the roofing membrane to the roofing composite.

In some embodiments, the coating is an acrylic coating.

In some embodiments, the coating has a thickness from 1 mil to 10 mils.

In some embodiments, the adhesive excludes a foam adhesive.

In some embodiments, a top surface of the roofing membrane is directly adhered to the adhesive.

In some embodiments, the roofing composite has a thickness from 10 mils to 40 mils.

In some embodiments, the adhesive has a thickness from 10 mils to 40 mils.

BRIEF DESCRIPTION OF THE DRAWINGS

Some embodiments of the disclosure are herein described, by way of example only, with reference to the accompanying drawings. With specific reference now to the drawings in detail, it is stressed that the embodiments shown are by way of example and for purposes of illustrative discussion of embodiments of the disclosure. In this regard, the description taken with the drawings makes apparent to those skilled in the art how embodiments of the disclosure may be practiced. Like reference numbers represent like parts throughout. The patent or application file contains at least one drawing executed in color. Copies of this patent or patent application publication with color drawing(s) will be provided by the Office upon request and payment of the necessary fee.

DETAILED DESCRIPTION

Figure 1:
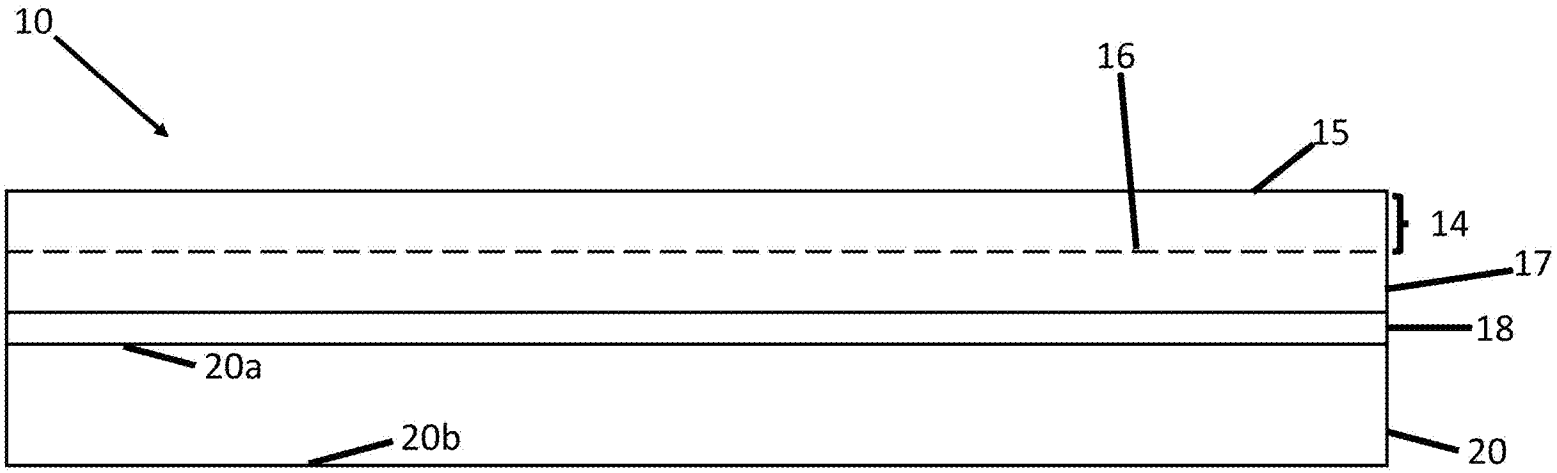
FIG. 1 depicts an exemplary embodiment of a composite roofing membrane.

Among those benefits and improvements that have been disclosed, other objects and advantages of this disclosure will become apparent from the following description taken in conjunction with the accompanying figures. Detailed embodiments of the present disclosure are disclosed herein; however, the disclosed embodiments are merely illustrative of the disclosure that may be embodied in various forms. In addition, each of the examples given regarding the various embodiments of the disclosure which are intended to be illustrative, and not restrictive.

Throughout the specification and claims, the following terms take the meanings explicitly associated herein, unless the context clearly dictates otherwise. The phrases "in one embodiment," "in an embodiment," and "in some embodiments" as used herein do not necessarily refer to the same embodiment(s), though it may. Furthermore, the phrases "in another embodiment" and "in some other embodiments" as used herein do not necessarily refer to a different embodiment, although it may. All embodiments of the disclosure are intended to be combinable without departing from the scope or spirit of the disclosure.

As used herein, terms such as "comprising" "including," and "having" do not limit the scope of a specific claim to the materials or steps recited by the claim.

All prior patents, publications, and test methods referenced herein are incorporated by reference in their entireties.

As used herein, "cap layer" refers to a top layer of the membrane that will be outward facing when the membrane is installed on a roof. In some embodiments, the cap layer comprises a polymer, including, without limitation thermoplastic polyolefin (TPO), polyvinyl chloride (PVC), Styrene-Butadien-Styrene (SBS) modified bitumen, polymethylmethacrylate (PMMA), or any combination thereof.

As used herein, "roofing substrate" refers to a plywood substrate, a glass substrate, a fiberglass substrate, (e.g., a fiberglass mat), a cellulosic substrate, an underlayment, a roofing membrane (e.g., a thermoplastic polyolefin (TPO) or polyvinyl chloride (PVC) membrane), a roof deck, a photovoltaic (PV) panel, a modified bitumen (MODBIT) substrate, a roll good, or any combination thereof. In some embodiments, the at least one roof substrate comprises a roof deck.

As used here, "silane modified polymer" is any is any organic polymer that has been substituted with at least one silane group. In some embodiments, a silane modified polymer is a silane terminated polymer.

As used herein, "a silane terminated polymer" is a silane modified polymer where the substitution of the at least one silane group is at an end of a chain of the polymer backbone.

As used herein, "silane" is any compound having the general formula $Si_nR_{2n+2}$, where R is hydrogen, an organic group, or any combination thereof. As used herein, a "silane" may also include any version of the aforementioned formula where at least one of the R groups is substituted with an organic group. In some embodiments, the silane is unsubstituted, such that all of the R groups may be the same. In some embodiments, the silane is substituted such that some of the R groups may be the same while others may differ from each other. In some embodiments, the silane is substituted such that all of the R groups are different. Examples of at least one substituent R group may include, but is not limited to at least one amino group (in the non-limiting case of an aminosilane) and at least one methoxy group (in the non-limiting case of a methoxysilane). In some embodiments, a silane may also encompass a bipodal silane.

As used herein, a "bipodal silane" is a silane having the general formula $R_3Si—R—SiR_3$.

As used herein, "adhere," "adheres," or "adhered" means that two surfaces are attached to one another via an adhesive so as to have a bond strength sufficient to achieve a rating of at least 1-90 when tested according to FM4474.

As used herein, "core layer" means a bottom layer of the membrane that will be facing the roof deck when the membrane is installed on a roof. In some embodiments of the present disclosure, the core layer may be an adhesive (as described herein), including, for example, a moisture-cure adhesive, comprising a silane-terminated polymer (as defined herein), PMMA, or combinations thereof.

As used herein, "reinforcing material" means a material positioned between the cap layer and the core layer of a roofing membrane and configured to provide structural strength or support to a roofing membrane. In some embodiments, the reinforcing material comprises a woven fabric, a non-woven fabric, a mesh, a scrim, or any combination thereof.

As used here, "directly contacts" means that at least a portion of a surface of a first material or layer touches at least a portion of a surface of a second material or layer.

As used herein, "adjacent" means that at least a portion of a surface of a first material or layer is next to at least a portion of a surface of a second material or layer.

Some embodiments of the present disclosure are directed to a composite roofing membrane. In some embodiments, the composite roofing membrane comprises a roofing membrane. In some embodiments, the roofing membrane comprises PVC, TPO, SBS modified bitumen, PMMA, or any combination thereof.

In some embodiments, the roofing membrane comprises a top surface and a bottom surface. In some embodiments, the top surface of the roofing membrane comprises a coating. In some embodiments, the coating may be any suitable coating that may be configured to reduce oil migration through the composite roofing membrane. In some embodiments, the coating is an acrylic coating.

In some embodiments, the coating on the top surface of the roofing membrane has a thickness from 1 mil to 10 mil, from 2 mil to 10 mil, from 3 mil to 10 mil, from 4 mil to 10 mil, from 5 mil to 10 mil, from 6 mil to 10 mil, from 7 mil to 10 mil, from 8 mil to 10 mil, from 9 mil to 10 mil, from 1 mil to 9 mil, from 1 mil to 8 mil, from 1 mil to 7 mil, from 1 mil to 6 mil, from 1 mil to 5 mil, from 1 mil to 4 mil, from 1 mil to 3 mil, from 1 mil to 2 mil, from 2 mil to 9 mil, from 3 mil to 8 mil, from 4 mil to 7 mil, or from 5 mil to 6 mil.

In some embodiments, the composite roofing membrane comprises a roofing composite. In some embodiments, the roofing composite comprises a cap layer. In some embodiments, the roofing composite comprises a reinforcing material. In some embodiments, the reinforcing material comprises a woven fabric, a non-woven fabric, a mesh, a scrim, or any combination thereof. In some embodiments the reinforcing material is bonded to a bottom surface of the cap layer. In some embodiments, the reinforcing material is at least partially embedded within the cap layer.

In some embodiments, the roofing composite of the roofing membrane has a thickness from 10 mil to 40 mil, from 15 mil to 40 mil, from 20 mil to 40 mil, from 25 mil to 40 mil, from 30 mil to 40 mil, from 35 mil to 40 mil, from 10 mil to 35 mil, from 10 mil to 30 mil, from 10 mil to 25 mil, from 10 mil to 20 mil, from 10 mil to 15 mil, from 15 mil to 35 mil, or from 20 mil to 30 mil.

In some embodiments, the roofing composite comprises a core layer. In some embodiments, the core layer directly contacts the reinforcing material. In some embodiments, the core layer is adjacent to a top surface of the roofing membrane. In some embodiments, the core layer directly contacts the top surface of the roofing membrane.

In some embodiments, the core layer comprises an adhesive. In some embodiments, the adhesive is a moisture-cure adhesive. In some embodiments, the adhesive comprises polyolefin polymer, poly-alpha-olefin (APAO/APO) polymer, Butyl, SIS, SBS, SEBS, SBR, ethylene vinyl acetate, poly vinyl acetate, acrylic adhesives, polyurethane, silane terminated polymer, asphaltic adhesives, hot melt adhesives, non-asphaltic adhesives, PMMA, or any combination thereof.

In some embodiments, the adhesive comprises a viscosity from 500 cp to 25,000 cp at 73 deg. C. In some embodiments, the adhesive comprises a viscosity from 1,000 cp to 25,000 cp, from 3,000 cp to 25,000 cp, from 5,000 cp to 25,000 cp, from 7,000 cp to 25,000 cp, from 9,000 cp to 25,000 cp, from 11,000 cp to 25,000 cp, from 13,000 cp to 25,000 cp, from 15,000 cp to 25,000 cp, from 17,000 cp to 25,000 cp, from 19,000 cp to 25,000 cp, from 21,000 cp to 25,000, from 23,000 cp to 25,000 cp, from 500 cp to 23,000 cp, from 500 cp to 21,000 cp, from 500 cp to 19,000 cp, from 500 cp to 17,000 cp, from 500 cp to 15,000 cp, from 500 cp to 13,000 cp, from 500 cp to 11,000 cp, from 500 cp to 9,000 cp, from 500 cp to 7,000 cp, from 500 cp to 5,000 cp, from 500 cp to 3,000 cp, from 500 cp to 1,000 cp, from 1,000 cp to 23,000 cp, from 3,000 cp to 21,000 cp, from 5,000 cp to 19,000 cp, from 7,000 cp to 17,000 cp, from 9,000 cp to 15,000 cp, or from 11,000 cp to 13,000 at 73 deg. C.

In some embodiments, the adhesive has a thickness from 10 mil to 40 mil, from 15 mil to 40 mil, from 20 mil to 40 mil, from 25 mil to 40 mil, from 30 mil to 40 mil, from 35 mil to 40 mil, from 10 mil to 35 mil, from 10 mil to 30 mil, from 10 mil to 25 mil, from 10 mil to 20 mil, from 10 mil to 15 mil, from 15 mil to 35 mil, or from 20 mil to 30 mil.

In some embodiments, the roofing composite and the adhesive, together, have a thickness from 20 mil to 80 mil, from 30 mil to 80 mil, from 40 mil to 80 mil, from 50 mil to 80 mil, from 60 mil to 80 mil, from 70 mil to 80 mil, from 20 mil to 70 mil, from 20 mil to 60 mil, from 20 mil to 50 mil, from 20 mil to 40 mil, from 20 mil to 30 mil, from 30 mil to 70 mil, or from 40 mil to 60 mil.

Some embodiments of the present disclosure are directed to a method of installation. In some embodiments the method includes obtaining a roofing membrane. In some embodiments, the roofing membrane is as described herein. In some embodiments, the roofing membrane comprises a top surface and a bottom surface. In some embodiments, the method includes attaching the bottom surface of the roofing membrane to a roofing substrate.

In some embodiments, the method includes obtaining a roofing composite. In some embodiments the roofing composite a cap layer and a reinforcing material as described herein.

In some embodiments, the method includes obtaining an adhesive. In some embodiments, the adhesive is as described herein. In some embodiments, the method includes applying the adhesive to the top surface of the roofing membrane and adhering the roofing composite directly to the adhesive so as to form a composite roofing membrane.

The present disclosure will now be described with reference to non-limiting exemplary embodiment depicted in FIG. 1.

FIG. 1 depicts an exemplary embodiment of a composite roofing membrane 10. In the exemplary embodiment of FIG. 1, the composite roofing membrane 10 comprises a roofing membrane 20. As shown in FIG. 1, the roofing membrane 20 comprises a top surface 20*a* and a bottom surface 20*b*. In some embodiments, the bottom surface 20*b* of the roofing membrane 20 may be attached to a roofing substrate. In the exemplary embodiment of FIG. 1, the roofing membrane 20 is an SBS membrane. In the exemplary embodiment of FIG. 1, a coating 18 is on the top surface 20*a* of the roofing membrane 20. In some embodiments, the coating 18 is an acrylic coating. In the exemplary embodiment of FIG. 1, the composite roofing membrane 10 also comprises a roofing composite 14. In the exemplary embodiment of FIG. 1, the roofing composite 14 comprises a cap layer 15 and a reinforcing material 16. As shown in FIG. 1, the composite roofing membrane 10 further comprises a core layer 17. In the exemplary embodiment of FIG. 1, the core layer 17 is a moisture-cure adhesive comprising a silane-terminated polymer, PMMA or any combination thereof.

Figure 3:
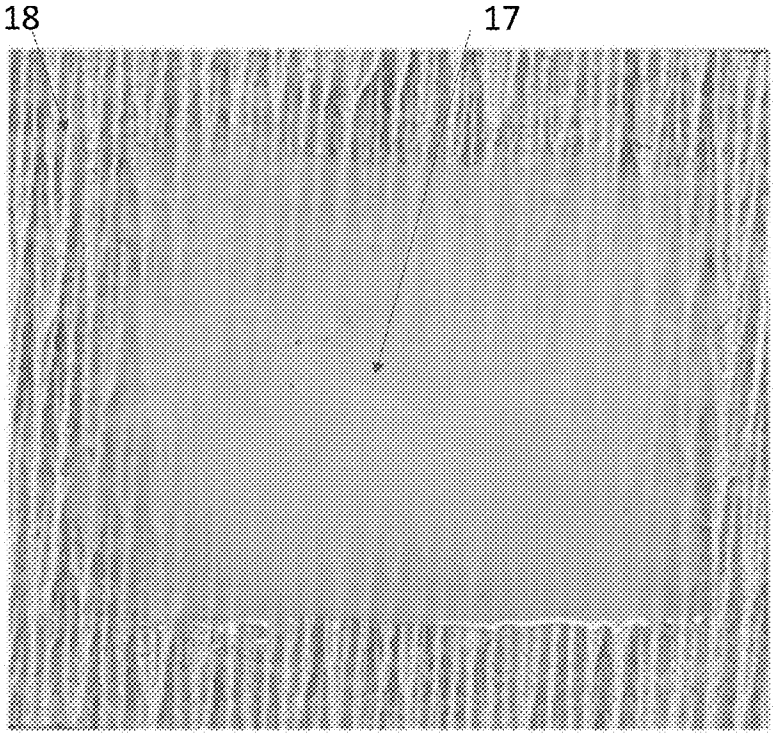
FIG. 3 is a photograph of the roofing membrane, the coating, and the core layer of the composite roofing membrane of FIG. 1.
Figure 2:
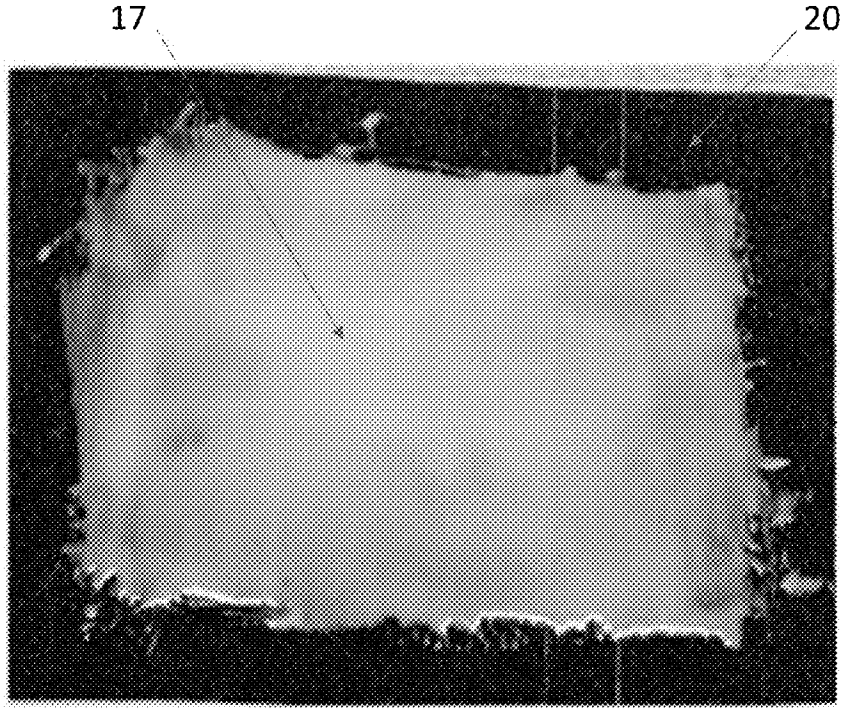
FIG. 2 is a photograph of the roofing membrane and the core layer of the composite roofing membrane of FIG. 1.

FIG. 2 is a photograph of core layer 17 directly applied to roofing membrane 20, while FIG. 3 is a photograph of core layer 17 applied to coating 18, which is applied on the roofing membrane. Restated, FIG. 2 shows the roofing membrane with the core layer applied, but without any coating between the roofing membrane and the core layer; while FIG. 3 shows a coating between the roofing membrane and the core layer. Comparing FIGS. 2 and 3, core layer 17 in FIG. 2 is more yellow than core layer 17 in FIG. 3, which is whiter. The yellow core layer indicates oil migration from the roofing membrane to the core layer. Thus, FIGS. 2-3 show that the coating reduces oil migration from the roofing membrane to the core layer, which reduces oil migration to the roofing composite adhered to the roofing membrane with the coating.

Variations, modifications and alterations to embodiments of the present disclosure described above will make themselves apparent to those skilled in the art. All such variations, modifications, alterations and the like are intended to fall within the spirit and scope of the present disclosure, limited solely by the appended claims.

While several embodiments of the present disclosure have been described, it is understood that these embodiments are illustrative only, and not restrictive, and that many modifications may become apparent to those of ordinary skill in the art. For example, all dimensions discussed herein are provided as examples only, and are intended to be illustrative and not restrictive.

Any feature or element that is positively identified in this description may also be specifically excluded as a feature or element of an embodiment of the present as defined in the claims.

The disclosure described herein may be practiced in the absence of any element or elements, limitation or limitations, which is not specifically disclosed herein. Thus, for example, in each instance herein, any of the terms "comprising," "consisting essentially of" and "consisting of" may be replaced with either of the other two terms, without altering their respective meanings as defined herein. The terms and expressions which have been employed are used as terms of description and not of limitation, and there is no intention in the use of such terms and expressions of excluding any equivalents of the features shown and described or portions thereof, but it is recognized that various modifications are possible within the scope of the disclosure.

The invention claimed is:

1. A roofing product comprising:

a roofing composite comprising: a cap layer, and a reinforcing material;

an adhesive, wherein the adhesive comprises a moisture-cure adhesive, wherein the adhesive comprises a silane-terminated polymer, a polymethylmethacrylate or combinations thereof; and a roofing membrane with a coating, wherein the roofing membrane comprises a styrene-butadiene-styrene-modified bitumen membrane, a thermoplastic polyolefin membrane, or a polyvinyl chloride membrane; wherein the coating is positioned between the adhesive and the roofing membrane, and wherein the roofing membrane is configured to be formed as a roll good.

2. The roofing product according to claim 1, wherein the adhesive directly contacts the coating.

3. The roofing product according to claim 1, wherein the coating is selected so as to reduce oil migration from the roofing membrane to the roofing composite.

4. The roofing product according to claim 3, wherein the coating is an acrylic coating.

5. The roofing product according to claim 4, wherein the coating has a thickness from 1 mil to 10 mils.

6. The roofing product according to claim 1, wherein the adhesive excludes a foam adhesive.

7. The roofing product according to claim 1, wherein the adhesive has a thickness from 10 mils to 40 mils.

8. The composite reefing membrane roofing product according to claim 1, wherein the roofing composite has a thickness from 10 mils to 40 mils.

9. A method of installation comprising:

obtaining a roofing membrane, wherein the roofing membrane comprises:

a styrene-butadiene-styrene-modified bitumen membrane, a thermoplastic polyolefin membrane, or a polyvinyl chloride membrane, and a coating, wherein the coating is on a top surface of the roofing membrane, installing a bottom surface of the roofing membrane to a roofing substrate, obtaining a roofing composite that is separate from the roofing membrane, wherein the roofing composite comprises:

a cap layer, and a reinforcing material, obtaining an adhesive that is separate from the roofing membrane and the roofing composite, wherein the adhesive comprises a moisture-cure adhesive, wherein the adhesive is selected from at least one of:

a silane-terminated polymer, a polymethylmethacrylate, or combinations thereof, applying the adhesive to the top surface of the roofing membrane that is attached to the roofing substrate, and adhering the roofing composite to the adhesive that is applied to the top surface of the roofing membrane so as to form a composite roofing membrane on the roofing substrate.

10. The method according to claim 9, wherein applying the adhesive to the top surface of the roofing membrane comprises directly applying the adhesive to the top surface without any intervening layer.

11. The method according to claim 9, wherein the coating is selected so as to reduce oil migration from the roofing membrane to the roofing composite.

12. The method according to claim 11, wherein the coating is an acrylic coating.

13. The method according to claim 12, wherein the coating has a thickness from 1 mil to 10 mils.

14. The method according to claim 9, wherein the adhesive excludes a foam adhesive.

15. The method according to claim 9, wherein the adhesive has a thickness from 10 mils to 40 mils.

16. The method according to claim 9, wherein the roofing composite has a thickness from 10 mils to 40 mils.

* * * * *